US007975444B2

(12) United States Patent
Holdsworth et al.

(10) Patent No.: US 7,975,444 B2
(45) Date of Patent: Jul. 12, 2011

(54) COUPLER SYSTEM FOR ADJACENT PRECAST CONCRETE MEMBERS AND METHOD OF CONNECTING

(75) Inventors: Steven E. Holdsworth, Centerville, OH (US); John W. Hanlon, Littleton, CO (US)

(73) Assignee: Barsplice Products, Inc., Dayton, OH (US)

( * ) Notice: Subject to any disclaimer, the term of this patent is extended or adjusted under 35 U.S.C. 154(b) by 240 days.

(21) Appl. No.: 12/315,922

(22) Filed: Dec. 8, 2008

(65) Prior Publication Data

US 2009/0139177 A1 Jun. 4, 2009

Related U.S. Application Data

(63) Continuation-in-part of application No. 29/293,491, filed on Nov. 29, 2007, now Pat. No. Des. 588,445.

(51) Int. Cl.
*E04C 5/08* (2006.01)
*E04C 5/16* (2006.01)

(52) U.S. Cl. ..... 52/223.7; 52/565; 52/585.1; 403/306; 403/296

(58) Field of Classification Search ..... 52/223.7, 52/426, 428, 562, 565, 583.1, 585.1, 587.1, 52/848, 849, 223.5, 223.6, 563, 568, 703; 403/296, 305, 306, 307; *E04C 5/08, 5/16*
See application file for complete search history.

(56) References Cited

U.S. PATENT DOCUMENTS

| | | | | | |
|---|---|---|---|---|---|
| 818,884 | A | * | 4/1906 | Grimm | 52/223.7 |
| 833,349 | A | * | 10/1906 | Starkey et al. | 403/305 |
| 1,807,715 | A | * | 6/1931 | Tucker | 105/422 |
| 2,935,767 | A | * | 5/1960 | Naegeli | 403/13 |
| 3,063,523 | A | * | 11/1962 | Triplett | 52/848 |
| 3,390,897 | A | * | 7/1968 | Moore | 285/33 |
| 3,820,293 | A | * | 6/1974 | Ohe et al. | 52/127.12 |
| 4,074,493 | A | * | 2/1978 | Outram | 52/848 |
| 4,161,089 | A | * | 7/1979 | Omansky | 52/223.7 |
| 4,196,557 | A | | 4/1980 | Silvander | |
| 4,324,037 | A | * | 4/1982 | Grady, II | 29/469 |
| 4,757,160 | A | * | 7/1988 | Lorenz et al. | 174/94 S |
| 4,781,006 | A | | 11/1988 | Haynes | |
| 4,887,691 | A | * | 12/1989 | Rotondo | 181/210 |
| 5,131,204 | A | * | 7/1992 | Hiendl | 52/848 |

(Continued)

FOREIGN PATENT DOCUMENTS

EP 1 561 874 A1 10/2005

(Continued)

*Primary Examiner* — Brian E Glessner
*Assistant Examiner* — Joseph J Sadlon
(74) *Attorney, Agent, or Firm* — Jacox, Meckstroth & Jenkins

(57) ABSTRACT

Adjacent precast reinforced concrete modules or members are secured together by a plurality of coupler systems each including a cast metal coupler body embedded in an edge portion of the first concrete member and connected by a coupling member to a reinforcing bar within the first concrete member. The coupler body has an internal cavity with a side opening and an end opening extending to the cavity, and reinforcing wings border the side opening. The second concrete member has another coupling member rigidly connected to an axially aligned reinforcing bar and includes an end portion with a threaded bore. A bolt is inserted into the cavity through the side opening, aligned with the end opening and then threaded into the bore where the bolt is tightened with a wrench extending into the cavity through the side opening. A reusable locating pin may be used to align the concrete members.

6 Claims, 5 Drawing Sheets

U.S. PATENT DOCUMENTS 5,309,691 A * 5/1994 Tolliver et al. ..... 52/583.1
5,355,647 A * 10/1994 Johnson et al. ..... 52/503
5,383,740 A 1/1995 Lancelot, III
5,410,847 A * 5/1995 Okawa et al. ..... 52/272
5,596,846 A * 1/1997 Kelly ..... 52/125.2
5,743,670 A * 4/1998 Ader ..... 403/296
5,974,761 A 11/1999 Mochizuki et al.
6,058,672 A 5/2000 McClellan
6,065,263 A * 5/2000 Taguchi ..... 52/583.1
6,327,829 B1 * 12/2001 Taguchi ..... 52/583.1
6,622,442 B2 * 9/2003 Kwon ..... 52/259
6,905,278 B2 * 6/2005 Kress et al. ..... 403/296
7,082,732 B2 * 8/2006 Titishov ..... 52/426
7,836,646 B2 * 11/2010 Matsufuji ..... 52/223.7
2004/0149951 A1 * 8/2004 Gethmann ..... 251/291

FOREIGN PATENT DOCUMENTS

GB 2 034 857 A 6/1980
JP 2005-264600 A 9/2005

* cited by examiner

COUPLER SYSTEM FOR ADJACENT PRECAST CONCRETE MEMBERS AND METHOD OF CONNECTING

RELATED APPLICATION

This application is a continuation-in-part of application Ser. No. 29/293,491, filed Nov. 29, 2007.

BACKGROUND OF THE INVENTION

This invention relates to connecting or coupling two adjacent reinforced precast concrete modules or sections or members together, and more specifically, for joining or coupling parallel spaced elongated reinforcing bars, commonly referred to as rebars, in one precast concrete member with corresponding and axially aligned reinforcing bars or rebars in adjacent precast concrete members. The reinforced precast concrete members may be in various forms, for example, in the form of precast concrete vertical column sections, such as disclosed in U.S. Pat. No. 4,196,557 and in European Patent No. 1,561,874 or in the form of precast vertical wall panels or sections.

In the construction of vertical walls from precast concrete wall panels or sections, it is common for the vertical rebars in each section to have exposed upper end portions projecting from the top edge surface of the section, and the lower portion of each section to have embedded tubular metal couplers. The couplers are attached to the lower end portions of the vertical reinforcing bars in the section and receive the upwardly projecting end portions of the vertically aligned reinforcing bars in the adjacent lower section. The tubular couplers are then pumped full of a grout mixture which sets up and couples the vertically aligned rebars together, for example, as disclosed in UK patent application No. 2,034,857 and in U.S. Pat. No. 5,383,740 and U.S. Pat. No. 5,974,761 and in Japanese patent application No. 2005-264600.

This grout-type of rebar connector or coupling is used for joining or connecting precast wall panels or sections which may be match-cast at a precast plant and are stacked at a construction site to form a vertical wall. In the match-cast method, sometimes alternate wall panels or sections are cast on a horizontal floor or bed surface between forms and with each panel having steel wire reinforcing mats and parallel spaced rebars. The rebars have end portions projecting from one edge surface of the panel and opposite end portions connected to grout-type tubular couplers adjacent the opposite edge surface of the wall panel. After the poured concrete in the alternate wall panels or sections cures, the forms are removed, and parallel rebars with attached tubular couplers are assembled between the opposing edge surfaces of the alternate concrete wall sections along with steel reinforcing grids or mats. The opposing edge surfaces of the alternate concrete wall sections are sprayed with a release agent, and the intermediate concrete wall section is then cast with concrete.

After the concrete forming all of the intermediate wall sections cures, the outer forms are removed and the match-cast sections are separated, ready to be placed in storage or transported to the construction site. After the wall sections arrive at the construction site, the sections are successively stacked with the aid of a crane to form a vertical wall. The embedded tubular rebar couplers in the lower portion of each wall section receive the upwardly projecting end portions of the corresponding vertically aligned rebars in the adjacent lower section. The couplers are then pumped full of grout for connecting the opposing end portions of the vertical rebars together, for example, as shown in the above-mentioned Japanese patent application.

The use of the grout-filled rebar couplers has disadvantages in that the grout requires several hours to cure and to develop a minimum tensile strength, and the vertically stacked wall sections usually require bracing until the grout cures. In addition, the grout-filled couplers can not be used at a construction site when the ambient temperature is low unless the wall receives a cover and the wall is heated under the cover. The grout-filled couplers also require significant time to fill, and there is no positive assurance that each coupler has been completely filled or that the grout has cured properly to provide the required coupling strength for the vertically aligned connected rebars. Typically, the compressive strength of field mixed grout must be determined by performing compressive tests on cubes of cured material at prescribed intervals. It can take one week for results to be known and for grout strength to be validated. The grout is also subject to shrinkage over a period of time, and this can result in weakening the splice or connection of the rebars.

It is also known to form precast concrete wall panels or sections or modules having embedded steel anchor plates connected by welds to the reinforcing bars within the sections or modules. After the concrete cures, and the modules are delivered to a construction site where the modules are stacked vertically with the use of an erection crane, the stacked modules are shimmed so that they are horizontal, and adjacent anchor plates are welded together to maintain panel alignment, sometimes with a separate weld plate. However, the welding requires special welding equipment at the construction site which adds significantly to the construction or erection costs, and sometimes the welds require certified welders and validation by ongoing tests and quality checks.

Other forms of connecting adjacent precast concrete wall panels or modules or sections use tie bolts which connect adjacent surface anchor plates welded to corresponding reinforcing rods or bars within the concrete sections, for example, as disclosed as U.S. Pat. No. 4,781,006. However, welding anchor plates to rebars is not desirable since it is difficult to determine if the welds produce acceptable connections. Another form of connecting precast concrete panels or members with threaded fasteners or bolts, is disclosed in U.S. Pat. No. 6,058,672. In this patent, U-shaped anchor members surround the reinforcing bars within one concrete member and have threaded tubular fittings for receiving threaded fasteners or bolts. The bolts extend through U-shaped brackets embedded within a second concrete member and have holes receiving reinforcing rods.

SUMMARY OF THE INVENTION

The present invention is directed to an improved coupler system for connecting precast reinforced concrete panels or modules or members having adjacent surfaces and axially aligned reinforcing bars embedded within the members. The coupler system of the invention replaces grout-filled splices or couplings of the type mentioned above and connects axially aligned reinforcing bars or rebars in adjacent members by coupling or connecting opposing end portions of the embedded rebars whereby the coupler system has a tensile strength greater than the tensile strength of the rebars. The coupler system of the invention is ideally suited for use in joining precast concrete floor and wall panels and provides for quickly stacking and connecting adjacent vertical wall panels to form a vertical concrete wall or quickly connecting adjacent floor panels to form a floor. The structural integrity of the coupler system may also be visually validated.

The coupler system may also be used at construction sites where there is a low ambient temperature. Thus after the precast wall panels are delivered to a construction site in cold weather, the wall panels may be quickly and efficiently stacked, and corresponding vertical rebars within the wall panels are connected in a manner that provides for continuous vertical rebars throughout the entire vertical height of the wall and with the full tensile strength of the rebars. The coupler system may also be used for quickly connecting and disconnecting precast concrete members or panels.

In accordance with the illustrated embodiment of the invention, a coupler system includes a cast metal coupler body having an internal cavity and a first end portion connected to a rebar within a precast concrete panel or section or member. The coupler body has a side opening extending to the cavity and a second end portion adjacent an edge surface of the concrete section or member and having an end opening aligned axially with the rebar. The adjacent precast concrete panel or member has an embedded coupling member with one end portion rigidly connected to an axially aligned rebar and an opposite end portion with a threaded bore aligned with and adjacent the end opening within the coupler body.

A threaded bolt is inserted into the cavity through the side opening and through the end opening in the coupler body and is threaded into the bore of the coupling member in the adjacent concrete member. Thus when the bolt is tightened with a wrench extending through the side opening into the cavity, the adjacent precast concrete members or sections are clamped tightly together. A reusable locating pin may be threaded into the bore of the coupling member within a lower concrete section at the construction site and has a frusto-conical end portion which projects upwardly into the end opening of the coupler body within an upper concrete section when the concrete sections are brought together for precisely aligning the adjacent precast concrete sections. The locating pin may be unthreaded from within the cavity and removed from the side opening. While only one coupler system of the invention is herein described, it is understood that each precast concrete section or member will usually have a plurality of the coupler systems.

Other features and advantages of the invention will be apparent from the following description, the accompanying drawings and the appended claims.

DESCRIPTION OF THE ILLUSTRATED EMBODIMENT

Figure 1:
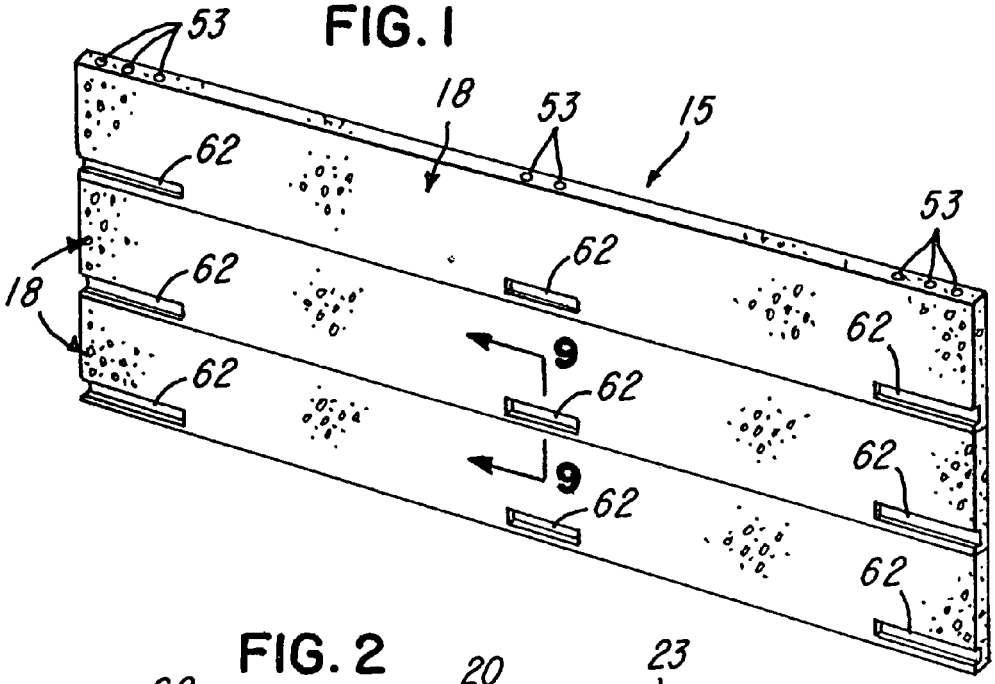
FIG. 1 is a perspective view of a portion of a vertical wall formed by match-casting precast wall panels or sections with the sections connected by a plurality of rebar coupler systems constructed in accordance with the invention.
Figure 2:
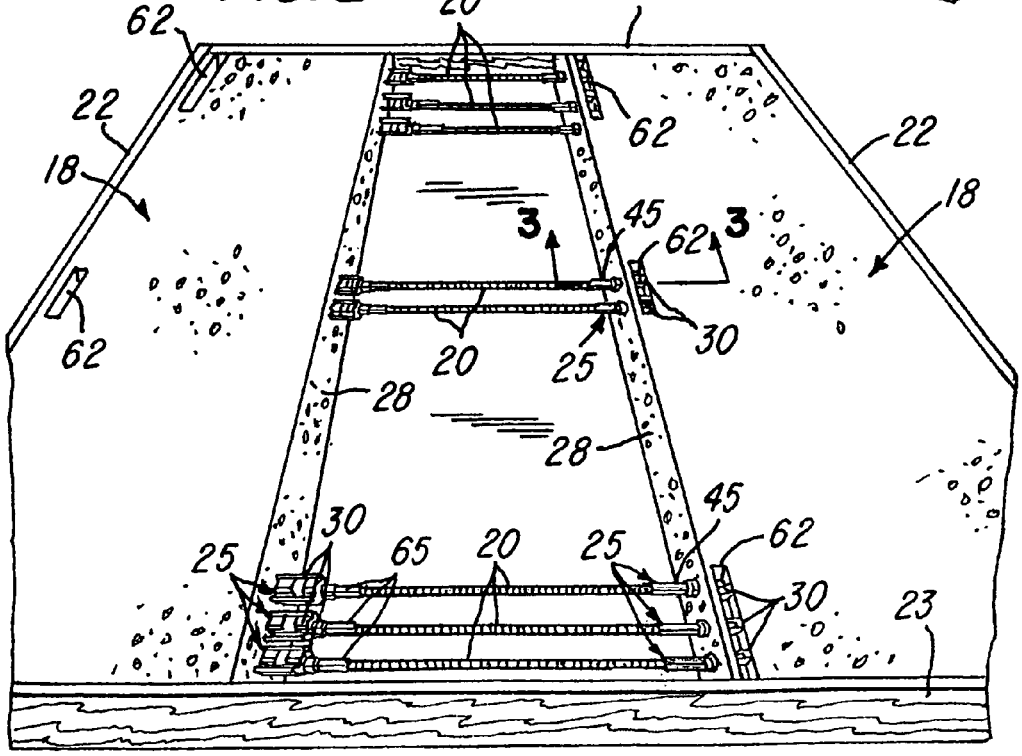
FIG. 2 is a perspective view illustrating a match-casting method for producing the precast concrete wall panels or sections shown in FIG. 1 and using the rebar coupler system of the invention.

FIG. 1 illustrates a portion of a vertical wall 15 formed by stacking three precast elongated flat wall panels or sections 18. The wall sections 18 are precast by a match-casting method, as illustrated in FIG. 2. Each of the concrete wall panels or sections 18 is precast at a precast plant and has conventional steel reinforcing grids or mats (not shown) and parallel spaced elongated steel reinforcing rods or bars, herein referred to as rebars 20. For illustration purposes, each precast concrete wall panel or section 18 has a plurality of three parallel spaced rebars 20 within each end portion and two parallel spaced rebars 20 in a middle portion. However, any number of rebars 20 may be used. When the wall sections 18 are match-cast on a horizontal floor or bed surface within form or bulkhead boards 22 and form or rail boards 23, the parallel spaced rebars 20 are positioned horizontally and temporarily spliced or connected. However, after the precast concrete wall sections 18 are cured and delivered to a construction site, the wall sections are stacked vertically with the aid of a crane to form the wall 15, as shown in FIG. 1, and the embedded rebars 20 extend vertically through the wall sections with corresponding rebars 20 in vertical alignment.

In order to match-cast the precast concrete wall panels or sections 18, the spaced alternate wall sections 18 (FIG. 2) are cast between the outer form boards 22 and 23 and parallel spaced inner bulkhead or form boards 22 (not shown) which are removed after the outer panels 18 have cured. Each of the parallel spaced rebars 20 within each of the alternate wall sections 18 is provided with a coupler system 25 constructed in accordance with the invention for positively connecting the axially aligned rebars 20 in the wall sections 18. The alternate wall sections 18 are precast between inner and outer form boards 22 and the form boards 23 with components of the rebar couplers 25 embedded within the longitudinal edge portions of each wall section 18. After the concrete forming the alternate wall sections 18 cures, which is usually within one day at a precast plant, the inner longitudinal bulkhead or form boards 22 are removed, and the rebars 20 and the coupling systems 25 for the intermediate wall section 18 are installed between the opposing longitudinal edge surfaces 28 of the alternate wall sections 18. As an alternate setup operation, all of the rebars 20 and coupler systems 25 may be installed prior to casting any of the panels or sections.

Figure 3:
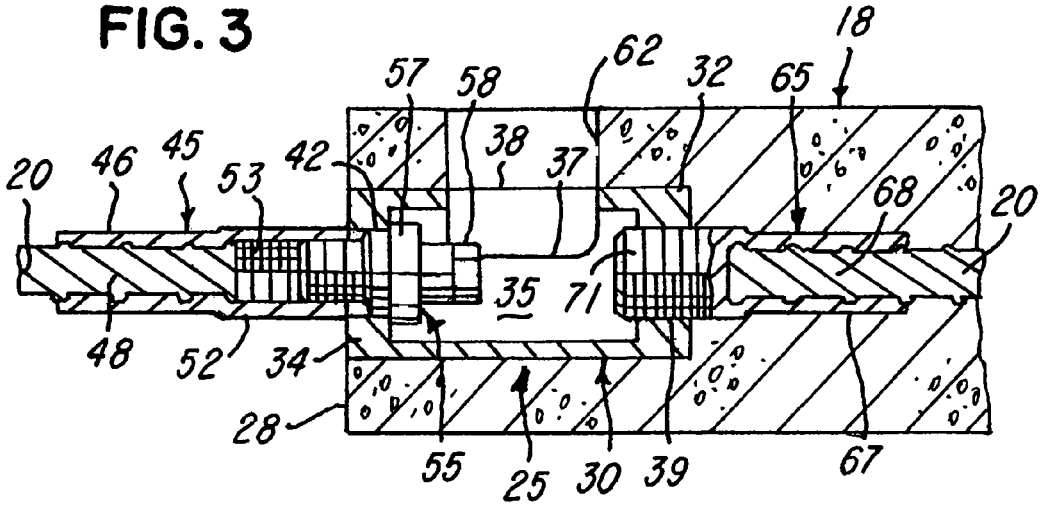
FIG. 3 is an enlarged fragmentary section taken generally on the line 3-3 of FIG. 2 and showing the coupler system of the invention being used in a match-cast process for producing the concrete wall panels.
Figure 4:
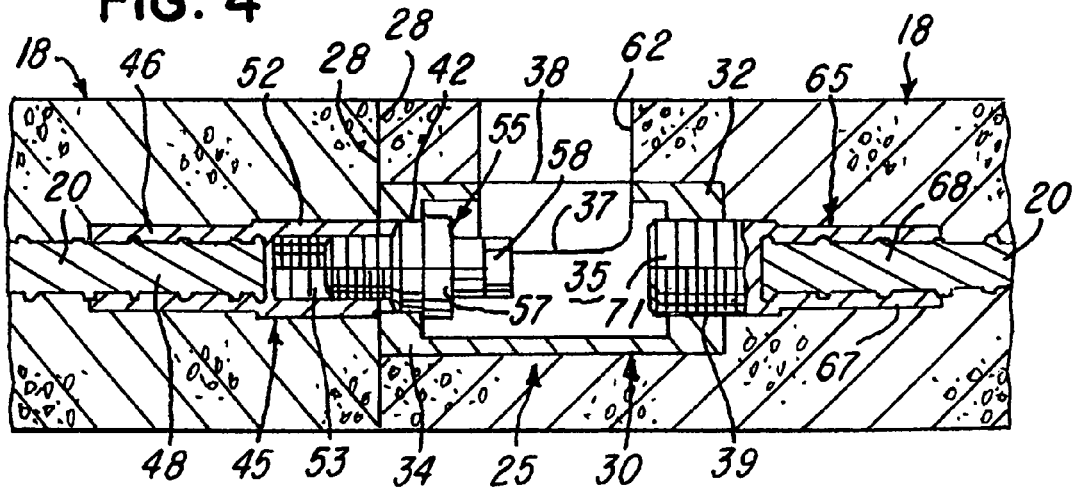
FIG. 4 is a fragmentary section similar to FIG. 3 after casting an intermediate wall panel between the previously cast spaced concrete wall panels of FIG. 2.

Referring to FIG. 3, each of the rebar coupler systems 25 for connecting opposing end portions of axially aligned rebars 20 in adjacent wall sections 18 includes a cast metal coupler body 30 having opposite end portions 32 and 34 and defining an internal cavity 35 with a side opening 37 between spaced reinforcing flange or wing portions 38. The end portion 32 has an internally threaded bore 39, and the opposite end portion 34 has a cylindrical bore or opening 42. Each coupler system 25 also includes an elongated coupling member 45 having a tubular end portion 46 rigidly secured or swaged onto an end portion 48 of a rebar 20. The coupling member 45 also has an opposite end portion 52 with an internally threaded bore 53 and an end surface flush with an edge surface 28 of a wall section 18.

When each rebar 20, with attached coupler body 30 and coupling member 45, is positioned between opposing edge surfaces 28 of the alternate panels or wall sections 18 (FIG. 2) prior to casting the intermediate wall section, the end portion 48 of each rebar and the attached coupling member 45 are positioned in axial alignment with the bore 42 in the coupler body 30 embedded in the adjacent alternate precast section 18. The coupler body 45 receives a removable and reusable bolt 55 (FIG. 3) inserted into the cavity 35 through the side opening 37 and threaded into the bore 53 of the coupling member 45. The reusable bolt 55 has an integrally formed and outwardly projecting flange portion 57 closely fitting the bore 42. The bolt 55 has a hexagonal shaped head portion 58 with a square or hexagonal recess adapted to receive a wrench inserted through the side opening 37 of the coupler body 30 and through an aligned opening or pocket 62 within the precast alternate wall section 18. Each coupler system 25 also includes an elongated coupling member 65 (FIG. 3) having a tubular end portion 67 rigidly secured or swaged onto an opposite end portion 68 of the rebar 20 within the wall section 18. The coupling member 65 has an opposite externally threaded end portion 71 threaded into the bore 39 within the end portion 32 of the coupler body 30.

As shown in FIGS. 2 & 3, one end portion 68 of each rebar 20 is connected by a corresponding coupling member 65 to the coupler body 30, and the opposite end portion 48 of each rebar 20 is connected to a corresponding coupling member 45. During the match-casting process, when each rebar 20 is positioned between the opposing edge surfaces 28 of the previously precast alternate wall sections 18, the coupler body 30 may be axially adjusted on the threaded end portion 71 of the coupling member 65 so that the coupler body 30 and the coupling member 45 on opposite end portions of the rebar 20 firmly contact the opposing edge surfaces 28 of the alternate precast wall sections 18.

After each intermediate wall panel or section 18 is poured with concrete between the opposing edge surfaces 28 and screened using the top surfaces of the adjacent alternate wall sections 18, the concrete is allowed to cure so that the top and bottom surfaces of the intermediate wall section 18 are flush with the corresponding top and bottom wall surfaces of the alternate wall sections 18. The reusable bolt 55 for each rebar 20 is then released from the corresponding coupling member 45 and is removed from the coupler body 30 through the side opening 37 and aligned pocket 62. After the match-cast precast wall sections 18 are removed from the outer form boards 22 and 23, they are ready to be placed in storage or shipped to a construction site.

Figure 5:
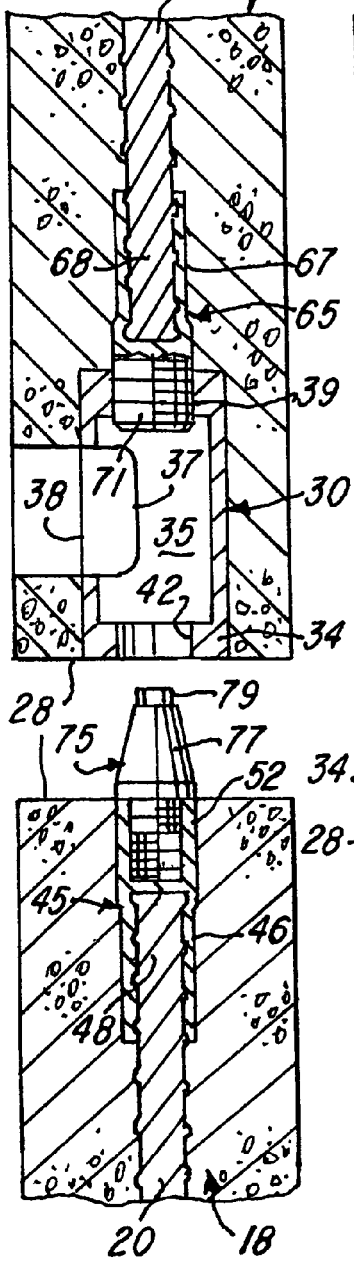
FIGS. 5-7 are vertical sections showing erection of two adjacent wall panels in vertical positions and being aligned and stacked.
Figure 6:
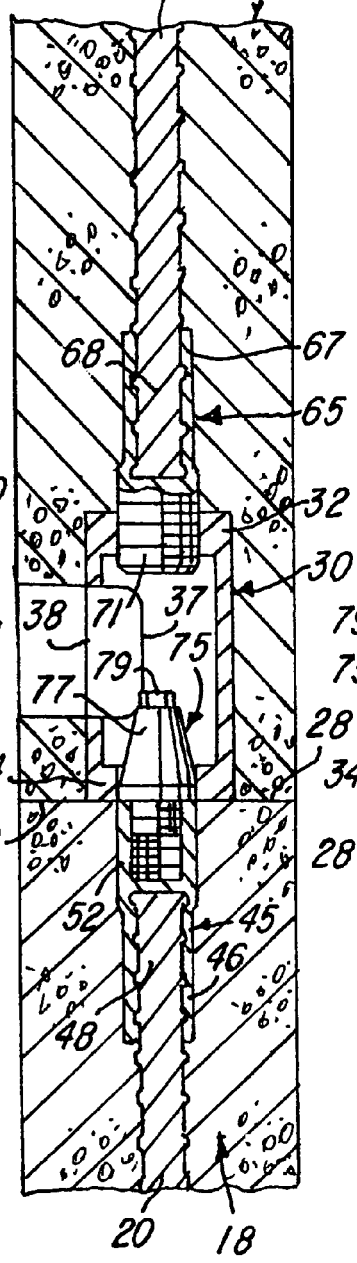
Figure 7:
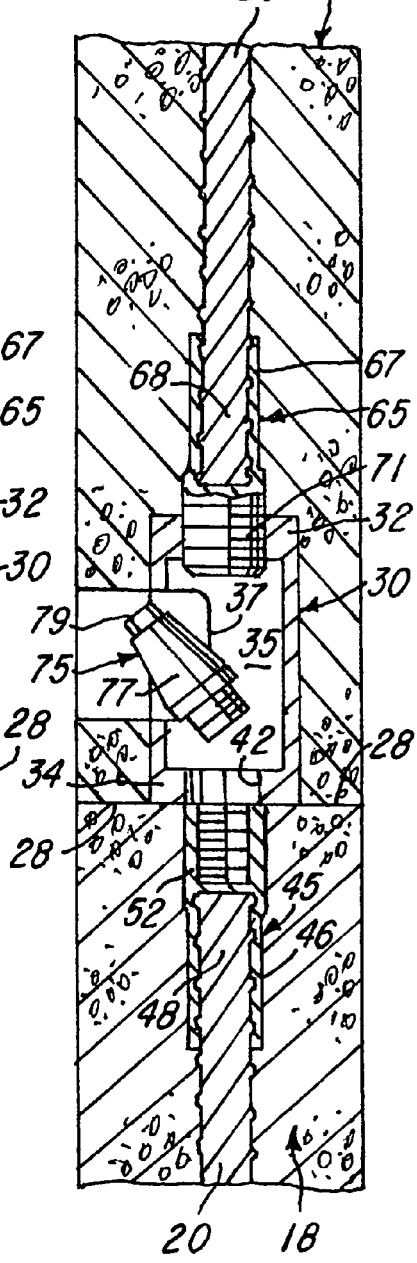

After the precast wall panels or sections 18 arrive at a construction site and are ready to be stacked to form the concrete wall 15, removable and reusable locating pins 75 (FIG. 5) are threaded into the bores 53 in the coupling members 45 usually located at opposite end portions of each wall section 18. The pins 75 provide for quick and convenient alignment of each vertical wall section 18 as it is lowered by a crane onto the top edge surface 28 of a vertical wall section 18 therebelow. Each locating pin 75 includes a tapered or frusto-conical surface 77 and a hexagonal head portion 79. The surface 77 enters the aligned cylindrical bore 42 within the coupler body 30 embedded in the lower edge portion of the wall section 18 thereabove. Any wall sections that are bowed from the effects of gravity, shrinkage, and creep, are pulled into substantial alignment at this stage. After the opposing edge surfaces 28 of the upper and lower wall sections 18 contact each other (FIG. 6), the locating pins 75 are unthreaded into the cavities 35 of the corresponding coupler bodies 30 and are removed through the aligned side openings 37 and pockets 62 within the lower portion of the upper wall section 18, as shown in FIG. 7.

Figure 8:
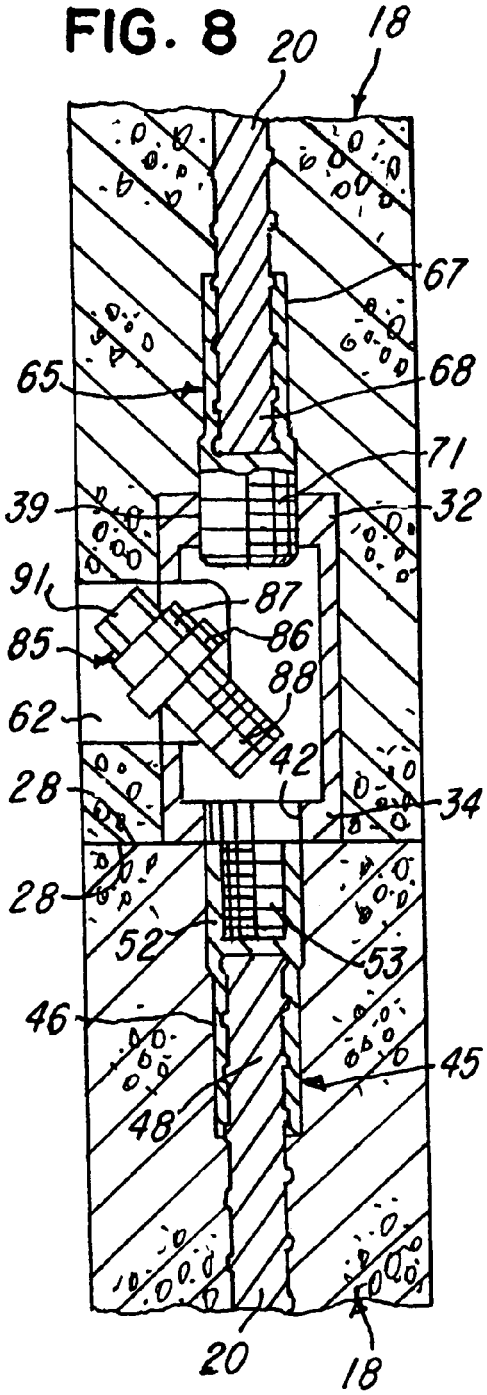
FIG. 8 is a fragmentary vertical section similar to FIG. 7 and showing the insertion of a bolt for connecting two adjacent panels.
Figure 9:
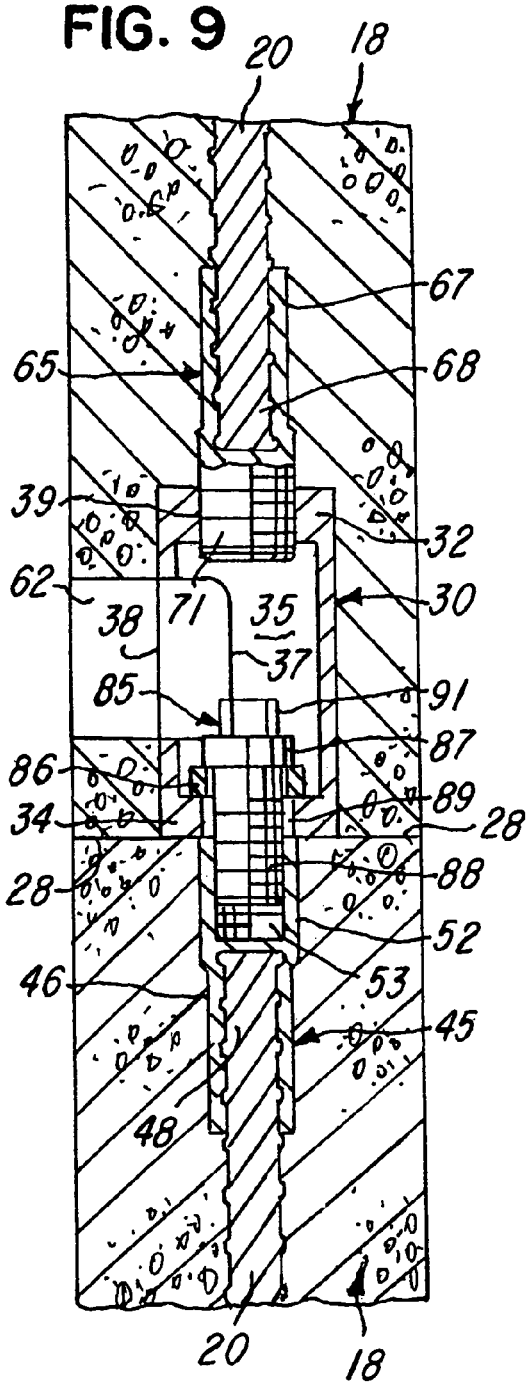
FIG. 9 is a fragmentary section similar to FIG. 8 and taken generally on the line 9-9 of FIG. 1 to show the wall panels after vertically aligned rebars are coupled together with the coupler system.
Figure 10:
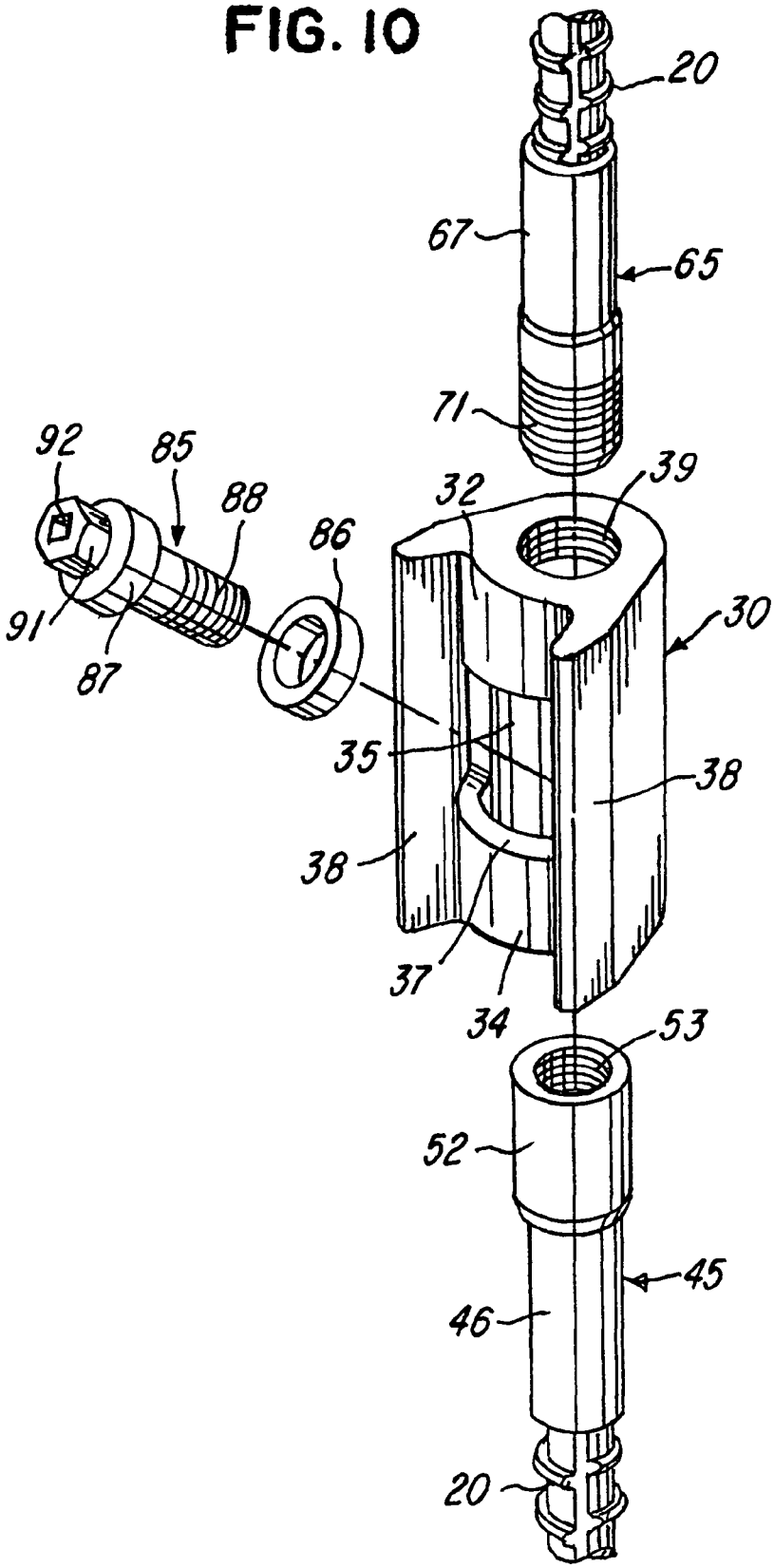
FIG. 10 is an exploded view of the components forming a coupler system in accordance with the invention.

Referring to FIGS. 8 & 9, the opposing and contacting edge surfaces 28 of the adjacent wall match-cast sections 18 are clamped together by inserting a locking and clamping bolt 85 into the cavity 35 of each coupler body 30 and then threading the bolt into the bore 53 within the adjacent coupling member 45 within the upper edge portion of the adjacent lower wall section 18. As shown in FIG. 9, each bolt 85 carries an annular washer 86 adjacent an outwardly projecting integral flange 87 and has a threaded shank portion 88 which is somewhat smaller in diameter than the cylindrical bore 42 to provide a clearance gap 89. The gap is provided to account for a certain amount of misalignment of adjacent wall sections. Each connecting bolt 85 also has a hexagonal head portion 91 with a non-circular or hexagonal or square recess 92 (FIG. 10) for receiving a socket wrench extending through the side opening 37 and aligned pocket 62 for tightening the bolt 85. Each pocket 62 is formed within the concrete before the concrete is poured by placing wood blocks, styrofoam, or other material in the side opening 37. After the concrete sets, the board is removed to form the pocket 62 for each coupler body 30. After all of the wall sections 18 are positively secured together by rigidly connecting the vertically aligned rebars 20, as shown in FIG. 9, the pockets 62 may be filled with a relatively dry mixture of concrete or mortar.

From the drawings and the above description, it is apparent that a coupler system constructed and used in accordance with the invention provides desirable features and advantages. More specifically, the mechanical coupler system 25 replaces grout-filled splices or couplers and thereby substantially reduces the installation time for directly connecting aligned rebars in adjacent precast concrete members by eliminating the curing time and the time required to fixture or brace the members while the grout is curing. The coupler system 25 of the invention also provides a reliable and dependable mechanical connection or coupling of aligned rebars 20 in adjacent precast concrete members in order to provide a tensile strength equal to or greater than the tensile strength of the rebars. In addition, when the precast concrete members are clamped together with the bolts 85, shear friction is increased between the adjacent surfaces 28.

The side opening 37 in each coupler body 30 also provides for conveniently inserting the axially aligned bolt 55, locating pin 75 or attachment bolt 85 and for conveniently using a ratchet-type socket wrench inserted through the side opening and into the cavity 35 of the coupler body. The flange or wing portions 38 of each coupler body 30 on opposite sides of the side opening 37 also provide for a stiffer and stronger coupler body and prevent bending or deformation when aligned connected rebars are subjected to a high tensile force.

As mentioned above, the coupler system 25 of the invention is also ideally suited for match-casting of various types of precast concrete sections or members. For example, the axial adjustment of each cast coupler body 30 on the attached coupling member 65 through means of the threaded connection, provides for precisely positioning each rebar 20 for a match-cast panel or section by assuring that the coupling member 25 and the coupler body 30 on opposite end portions of the rebar firmly contact the form boards 22 or the opposing edge surfaces 28 of the alternate precast concrete sections 18. Additional features are provided by the reusable alignment bolts 55 and the reusable locating pins 75 which reduce the time for positioning the rebars 20 when match-casting, and the time for precisely aligning an upper precast concrete panel or section 18 on an adjacent lower precast concrete panel or section 18. The coupler system 25 of the invention further eliminates the requirement for any welding of rebars or components since welding is time consuming, requires certified welders, and the quality of the weld must be validated by an inspector. The cast metal coupler body 30 also minimizes machining which helps to reduce the weight and cost of the coupler system.

While the form of coupler system and the method of using the system herein described constitute a preferred embodiment of the invention, it is to be understood that the invention is not limited to this precise method and form of coupler system described, and that changes made therein without departing from the scope and spirit of the invention as defined in the appended claims.

What is claimed is:

1. The coupler system connecting a first precast concrete member to a second precast concrete member with said first concrete member having a surface adjacent an opposing surface of said second concrete member, each said concrete member including an embedded elongated solid reinforcing bar having longitudinally spaced and outwardly projecting ribs, with said reinforcing bar in said first concrete member being substantially axially aligned with said reinforcing bar in said second concrete member, said coupler system comprising a one-piece metal coupler body embedded in said first concrete member and defining an internal cavity and a side opening extending to said cavity, said coupler body including a first end portion having an internally threaded bore and a second end portion adjacent said surface of said first concrete member and having a bore aligned axially with said threaded bore, an elongated first coupling member having an externally threaded end portion axially adjustable within said threaded bore in said first end portion of said coupler body and having a tubular second end portion swaged to said ribs of said reinforcing bar within said first concrete member, an elongated second coupling member embedded in said second concrete member and having a first end portion with an internally threaded bore adjacent said surface of said second concrete member, said second coupling member including a tubular second end portion swaged to said ribs of said reinforcing bar within said second concrete member, a bolt insertable into said cavity through said side opening and having a shank portion extending through said bore in said second end portion of said coupler body and threaded into said threaded bore within said second coupling member, and said bolt including a radially outwardly projecting portion engaging said second end portion of said one-piece coupler body.

2. The coupler system as defined in claim 1 wherein said bolt has a head portion adapted to receive a wrench projecting through said side opening, and said head portion is integrally connected to said shank portion by a flange portion forming said radially outwardly projecting portion of said bolt.

3. The coupler system as defined in claim 1 wherein said bolt has an annular washer on said shank portion and forming said outwardly projecting portion of said bolt.

4. The coupler system as defined in claim 3 wherein said bore within said second end portion of said coupler body is larger in diameter than said shank portion of said bolt to define an annular clearance gap therebetween.

5. The coupler system as defined in claim 1 wherein said one-piece coupler body comprises a cast metal body having integrally cast and outwardly projecting wing portions spaced with said side opening between said wing portions to reinforce said coupler body against tension and sending forces exerted on said end portions of said body.

6. The coupler system as defined in claim 1 in combination with a locating pin threadably connected to said internally threaded bore within first end portion of said second coupling member in said second concrete member and having a head portion adapted to receive a wrench projecting through said side opening in said coupler body for removing said locating pin through said side opening after said first and second concrete members are positioned together.

* * * * *